US005725074A

United States Patent [19]

Richter et al.

[11] Patent Number: 5,725,074

[45] Date of Patent: Mar. 10, 1998

[54] APPARATUS FOR SUPPORTING AND GUIDING AN ELEVATOR

[75] Inventors: Utz Richter, Ebikon; Christoph Liebetrau, Menziken, both of Switzerland

[73] Assignee: Inventio AG, Hergiswil NW, Switzerland

[21] Appl. No.: 645,409

[22] Filed: May 13, 1996

[30] Foreign Application Priority Data

Jun. 2, 1995 [CH] Switzerland ..... 01624/95

[51] Int. Cl.[6] ..... B66B 7/02

[52] U.S. Cl. ..... 187/406; 52/745.17

[58] Field of Search ..... 187/239, 405, 187/408, 410, 414; 52/745.17, 745.19

[56] References Cited

U.S. PATENT DOCUMENTS 3,814,027 6/1974 Vice ..... 104/247
5,284,226 2/1994 Makimura et al. ..... 187/95

FOREIGN PATENT DOCUMENTS 0546321 6/1993 European Pat. Off. .
1506479 12/1969 Germany .
9302119 5/1993 Germany .

*Primary Examiner*—Kenneth Noland
*Attorney, Agent, or Firm*—William J. Clemens

[57] ABSTRACT

An appendable elevator system includes an elevator car guide structure having two column-like guide modules (10) on which a self-propelled car (5) runs. The guide modules (10) are constructed as a plurality of extruded lightweight metal tubular sections including planar running surfaces (16, 25, 29, 30) for contact with guide rollers (9) and wheels (7, 8) of the car (5), anchoring grooves (33, 34, 35, 36), guide grooves (31, 32) and a brake arm (37) formed on an exterior thereof. An interior of the guide module (10) receives a counterweight (18) guided by the guide grooves (31, 32) and a buffer (44, 45, 46) and is accessible for assembly and maintenance through a removable maintenance lid (43). The sections of guide modules (10) are connected with one another and with a foundation module (12) and with a shaft head module (13) by groove strips (40), connecting straps (41) and screws (42) which engage the anchoring grooves (33, 34, 35, 36).

18 Claims, 4 Drawing Sheets

APPARATUS FOR SUPPORTING AND GUIDING AN ELEVATOR

BACKGROUND OF THE INVENTION

The present invention relates generally to elevators for transporting persons and goods and, in particular, to a support and guide for an elevator which can be attached to an outside wall of an existing building.

An elevator which is supported and guided by two columns in which counterweights run is described in the German published specification DE 1 506 479. A drive has toothed pinons at both sides of a car which engage a roller chain embedded in the columns in a kink resistant matter. The columns are constructed as steel robes which include welded-on lobes for a base fastening and a traverse connection at the head end. For receiving the roller chain, a U-shaped section is welded onto one side of each of the columns extending over the elevator travel path, the open side of which U-shaped section is reduced by means of laterally mounted angle sections (FIG. 5) to a slot which serves for the lateral guidance of the engaging drive shaft pinion. The counterweight running in the robe is circular in shape and is maintained out of contact with the inner wall of the robe at the bottom and the top by means of three-roller guides. The elevator car is guided by rollers which run directly on the outside wall of the tube.

It is a disadvantage that the guides must be produced individually for each elevator installation due to differences in length, terminating fittings and roller chain receptacle and installation. In addition, external devices must be attached for the suspension of the roller chain will be integrated load measurement. The counterweight running in the tube is not secure against rotation and must be installed as a whole unit from the top of the column. The guide rollers on the car, which run on the outer side of the robe, have only a linear contact with the running surface.

SUMMARY OF THE INVENTION

The present invention concerns an apparatus for supporting and guiding an elevator comprising: a pair of guide modules for guiding an elevator car, each of the guide modules having a sectional tubular body with at least one generally planar running surface formed on an exterior surface thereof for contact with a wheel mounted on the car, at least one anchoring groove formed on the exterior surface for attaching the sections together and at least one brake arm extending outwardly therefrom for contact with a car-arresting device mounted on the car.

It is therefore an object of the present invention to provide an elevator guide which does not have the above mentioned disadvantages and which in a simple and effective manner combines the basic functions of guiding the car, braking the car and fastening the guide rail.

The invention has the advantage of being formed of extruded sections which offer the possibility of integrating structures for guidance, connection and brake-arresting functions so that no finishing operations such as the drilling of holes, the tapping of threads, bending, welding and so forth are necessary and a section cut to the required length is therefore available as a component ready for installation.

Planar running surfaces on the sections, which sections are round in basic shape, result in optimum conditions in respect of static friction and slip for driving and supporting wheels as well as in a peripheral speed of the drive and supporting wheels, which is the same over the entire running surface width. This proves to be a significant advantage by comparison with known concave-convex shapes of contact lines between wheels and running surfaces.

Formed anchoring grooves on the exterior of the sections offer a number of further advantages for different problem-free fastening and connecting functions. For example, groove strips can be pushed into the anchoring grooves and screwed together with connecting straps. A formed brake arm can be engaged by a typical brake-arresting device.

The advantages of a desired reduction in weight for lighter transport and more comfortable manipulation result from the use of lightweight metal as constructional material. Through appropriate accuracy of shape and surface quality, the finishing treatment also becomes superfluous for the running surfaces. Furthermore, the corrosion resistance of the material used does not require a surface protection material which must be renewed periodically.

A surface coating stabilizing the coefficient of friction results in practically constant friction values for dry and moist running track surface.

Separate guide and brake surfaces prevent an impairment of the travel comfort in consequence of locally rough surfaces after car-arresting brakings.

Guide grooves formed in the interior of the sections result in a secure guidance for a counterweight with no rotation, which counterweight is movable inside the section. The counterweight is accessible for assembly and maintenance through a closable maintenance opening in the section wall. The maintenance opening also serves for installation and maintenance of a counterweight buffer positioned at the bottom of each guide module.

Furthermore, the guide module sections can be transversely connected by simple standard sections at the upper and/or lower end in that these transverse connections are screwed together directly with the anchoring grooves.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
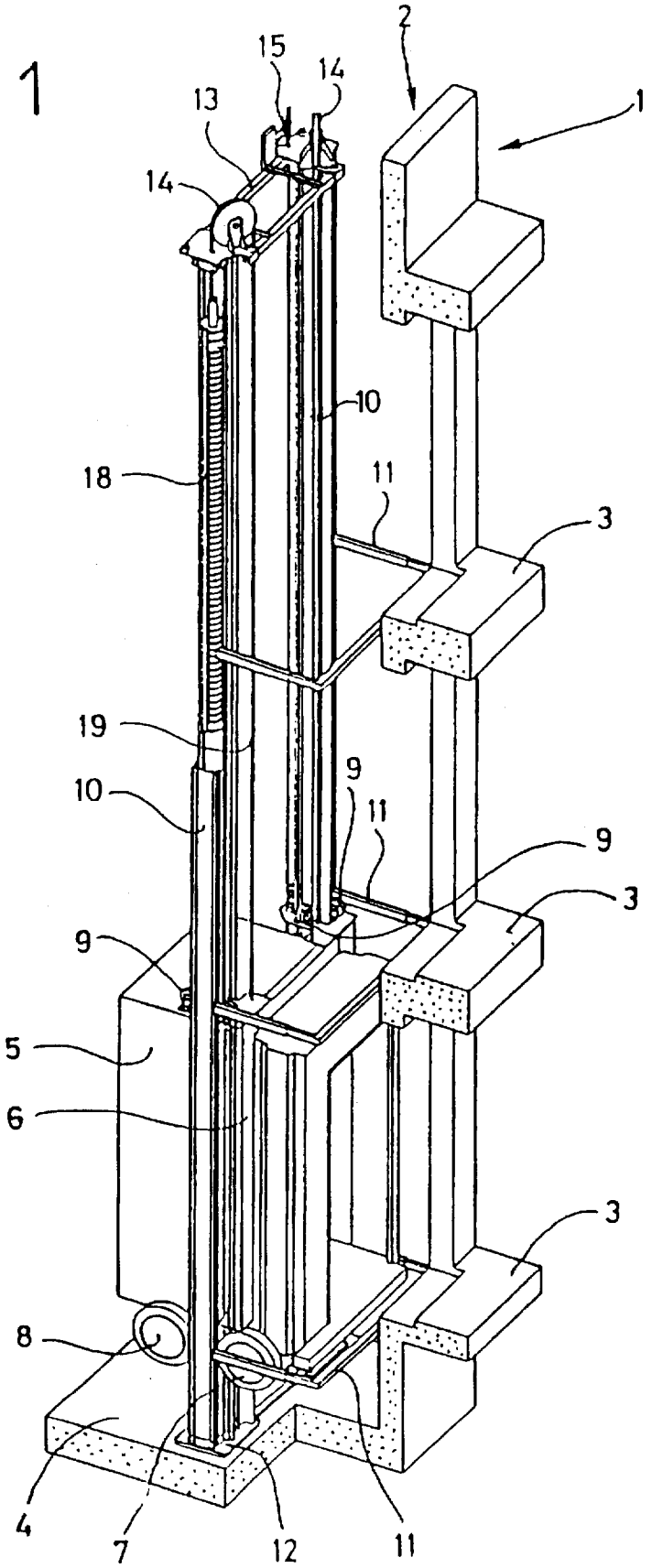
FIG. 1 is a schematic perspective view of an elevator mounted on an outer wall of a building in accordance with the present invention viewed from inside the building.

There is shown in the FIG. 1, an appendable elevator system attached to an outer surface of an outside wall 2 of a building 1. Two vertically extending, generally hollow guide modules 10 are supported it opposite ends and fastened at the spacing of a track width on lateral ends of a foundation module 12 resting on a building base area 4. Upper ends of the guide modules 10 are closed off by a shaft head module 13 spanning the track width. Between the guide modules 10, there is positioned a car 5 which has a drive (not shown) mounted on an underside thereof. The drive drives a pair of drive wheels 7 mounted on opposite sides of the car 5, which wheels run along on associated running surfaces of the guide modules 10. The drive wheels 7 cooperate with a pair of supporting wheels 8 mounted adjacent to but spaced from associated ones of the drive wheels 7 and running on associated running surfaces on opposite sides of the guide modules 10 from the running surfaces for the drive wheels 7. Guide rollers 9, which guide the car 5 in an horizontal plane, are mounted on an upper side of the car in two groups of three rollers each for running on three running surfaces formed on each of the guide modules 10.

The car 5 is retained in an encircling support frame 6 and is attached at the upper side adjacent the guide rollers 9 to one end of each of a pair of support elements or cables 19. The cables 19 are guided over a pair of deflecting rollers 14 mounted at opposite ends of the shaft head module 13 and have opposite ends attached to associated ones of a pair of counterweights 18 running within the guide modules 10 as shown in the FIG. 2. A speed limiter 15, which is driven by a limiter cable (not shown) fastened to the car 5 and guided by a lower deflecting roller (not shown) fastened on the left-hand side of the foundation module 12, is mounted on the left-hand side of the shaft head module 13. In the case of the elevator car speed exceeding a maximum permissible speed, a not-illustrated car arresting device mounted on the car 5 is triggered in known manner. The guide modules 10 are attached to the building 1 at each of a plurality of floors 3 by respective fastening modules 11 each in the form of a generally U-shaped frame part fastened to the outer surface of the outside wall 2.

Figure 2:
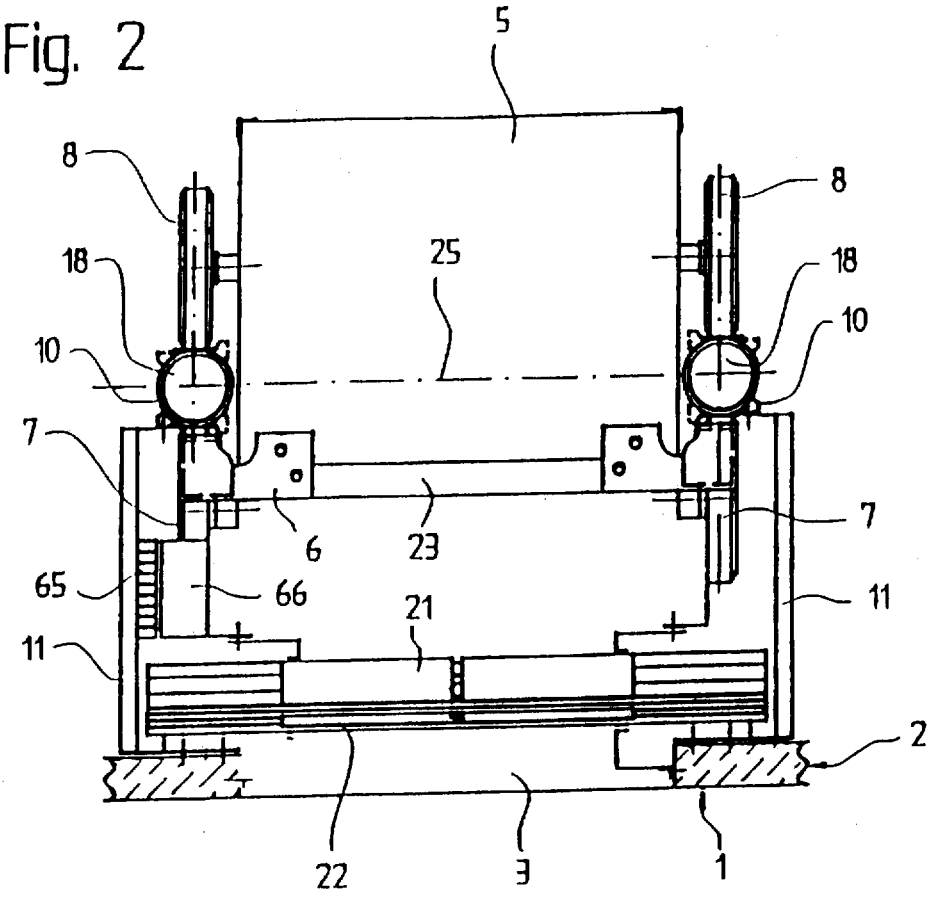
FIG. 2 a top plan view of the elevator shown in the FIG. 1.

The appendable elevator system is illustrated in the FIG. 2 in a top plan view with the wall 2 and the guide modules 10 in cross-section. The support frame 6 with a yoke 23 is positioned between the wall 2 and a guide axis 25 extending between the guide modules 10 generally parallel to the wall. Parts of the support frame 6 are cut away for the purpose of making visible the entire cross-section of the guide modules 10 with the counterweights 18 running inside. A first element 65 of a shaft position device is mounted on one of the horizontal, telescopically extendible connecting arms of each of the fastening modules 11. A second element 66 of the shaft position device is mounted on the car 5 and is arranged at a small spacing relative to the first elements 65, preferably on the roof of the car, for generating car position information. The building 1 includes a shaft door 22 for each floor 3 and the car 5 includes a car door 21.

Figure 3:
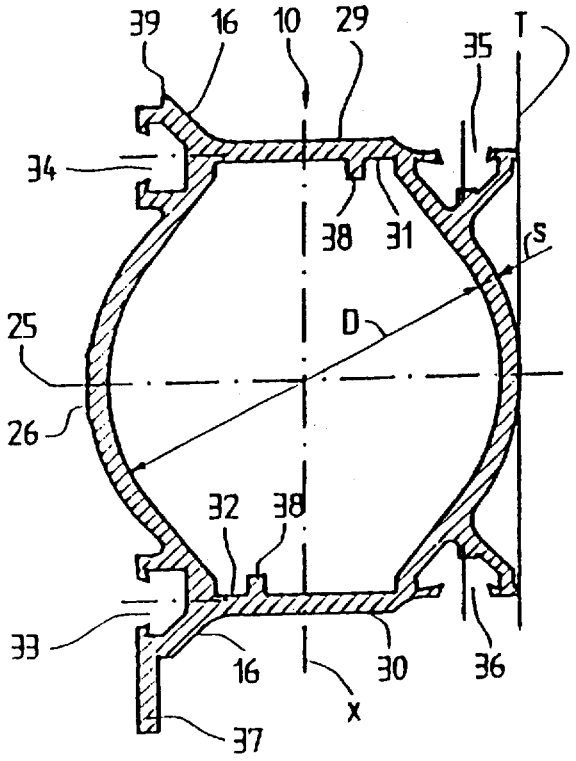
FIG. 3 an enlarged cross-sectional view taken through one of the guide modules shown in the FIG. 2.

One of the guide modules 10 is shown in more detail in cross-section in the FIG. 3. The guide module body is generally tubular and encloses an open internal area generally having a diameter "D" with a substantially continuous wall thickness "s". The center of the basic shape is an intersection of the guide axis 25 with an "X" axis extending at a right angle thereto. Extending parallel to the guide axis 25 with a width of about "D/2" is a generally planar first running surface 29 for the supporting wheel 8 formed on an outer surface of the guide body. A generally planar second running surface 30 for the drive wheel 7 is formed opposite the first surface 29. The surfaces 29 and 30 extend longitudinally along the guide modules 10 to permit the wheels 7 and 8 to travel to each of the floors 3. Adjoining a left-hand side of each of the planar running surfaces 29 and 30 is an associated one of a pair of generally planar third and fourth running surfaces 16 for two of the three guide rollers 9 disposed at each side of the car 5. The surfaces 16 extend obliquely at about 45° to the surfaces 29 and 30. At a left-hand outside surface of the guide body there is formed a generally planar fifth running surface 26, on which the third roller of the three guide rollers 9 runs, positioned generally symmetrical relative to the guide axis 25.

The guide module 10 is formed of a plurality of sections each having the above described profile and four anchoring grooves 33, 34, 35 and 36 formed adjacent to side edges of the running surfaces 29 and 30 which grooves open outwardly. The anchoring grooves 33, 34, 35 and 36 each have inwardly extending flanges formed along opposite sides of the openings thereof which can be engaged by anchoring blocks or groove strips (not shown). The anchoring grooves 35 and 36 have mutually opposed groove openings, the center lines of which extend generally parallel to the "X" axis. The right-hand side outward edges of the anchoring grooves 35 and 36 lie in a plane "T" which is vertically tangent to the guide body at the guide axis 25. The from surfaces of the anchoring grooves 35 and 36 are each parallel to, but set back somewhat relative to, the running surfaces 29 and 30 respectively. The axes of the anchoring grooves 33 and 34 each extend at equal spacing from and parallel to the guide axis 25 and the openings of these anchoring grooves are each directed outwardly to the left. The front surfaces of the anchoring grooves 33 and 34 are set back relative to the outside wall surface 26 by about twice the wall thickness "s". A portion of the wall of the anchoring groove 33 away from the guide body is extended outwardly generally parallel to the "X" axis as a brake arm 37 which is somewhat thicker than the wall thickness "s". A portion of the wall of the anchoring groove 34 is extended as a short projection or rib 39 outwardly for the purpose extending the width of the adjacent running surface 16. As described below, the anchoring grooves 33, 34, 35 and 36 are used to attach the sections of the guide module 10 to one another.

A pair of guide grooves 31 and 32 are formed adjacent the anchoring grooves 35 and 33 respectively on an inner surface of the guide body. A base of the guide groove 31 is formed by the flat outside running surface 29, a right-hand wall is formed by the wall surrounding the anchoring groove 35 and a left-hand wall is formed by an inwardly extending rib 38. A base of the guide groove 32 is formed by the flat outside running surface 30, a left-hand wall is formed by the wall surrounding the anchoring groove 33 and a right-hand wall is formed by another inwardly extending rib 38. Adjacent the guide groove 31, the inner surface of the guide body extends generally parallel to the running surface 29 to a base of the anchoring groove 34 to an inwardly directed step and, adjacent the guide groove 32, the inner surface of the guide body extends generally parallel to the running surface 30 to another inwardly directed step.

Figure 4:
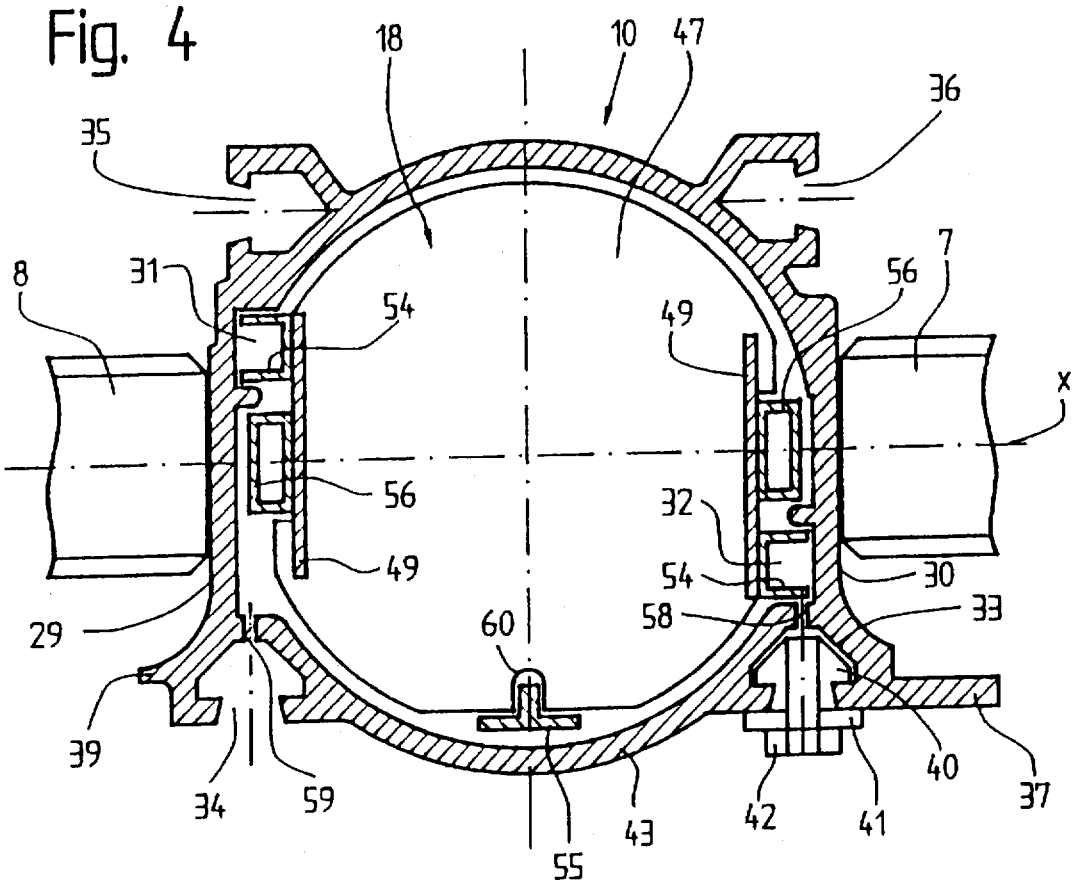
FIG. 4 an enlarged cross-sectional view of the guide module shown in the FIG. 3 with a counterweight, a maintenance lid, a connecting strap, a drive wheel and a supporting wheel.

There is shown in the FIG. 4 the guide module 10 with the counterweight 18 movably mounted inside. A groove strip 40 is pushed into the anchoring groove 33 and fastened together with a connecting strap 41 by a screw 42. Although not shown, a similar groove strip is pushed into the anchoring groove 34 and fastened together with a connecting strap by a screw. A portion of the guide body between the anchoring grooves 33 and 34 is designated as a maintenance lid 43 and is separable from the body at a pair of joints 58 and 59 when the connecting straps 41 are removed from the grooves 33 and 34 in the region of the joints. A counterweight unit 47 has a basically round shape and is flattened laterally adjacent a pair of vertically extending side sections 56 to form abutments. The unit 47 also is flattened adjacent the lid 43 with a securing groove 60 formed therein for receiving a generally T-shaped retaining section 55. Side plates 49, which carry sliding guide members 54 engaging the guide grooves 31 and 32, are fastened to the side sections 56. Portions of the supporting wheel 8 and the drive wheel 7 rolling along the running surfaces 29 and 30 are illustrated.

Figure 5:
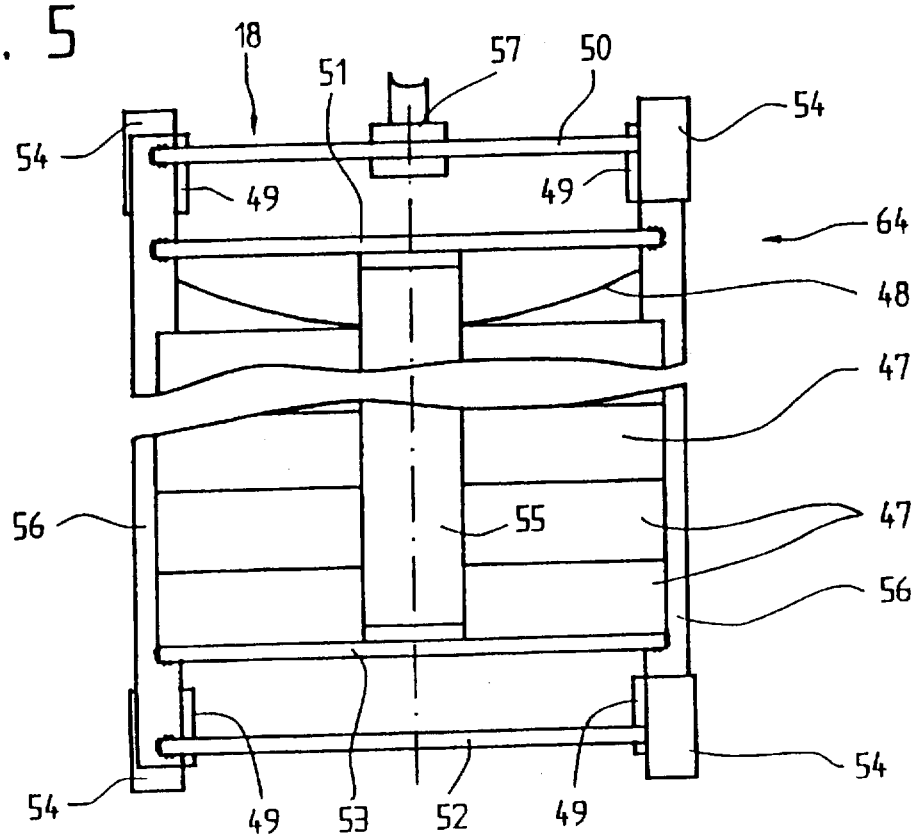
FIG. 5 a side elevation view of the counterweight shown in the FIG. 4.

In FIG. 5, the entire counterweight 18 is illustrated in side elevation. The side sections 56 are connected together by a plurality of horizontally extending retaining plates. An upper retaining plate 50 is attached to tops of the sections 56 and a first intermediate retaining plate 51 is attached at locations spaced below the plate 50. A lower retaining plate 52 is attached to bottoms of the sections 56 and a second intermediate retaining plate 53 is attached at locations spaced above the plate 52.

The sliding guide members 54 are each fastened at to the side sections 56 by the side plates 49 at the upper and lower ends thereof. These parts form a counterweight frame 64. Four counterweight units 47, which are inserted into the frame 64 and stacked one above the other, are shown wherein the lowermost counterweight unit 47 rests on the retaining plate 53. The counterweight units 47 are secured against slipping out of the frame by the retaining section 55 which is secured to the retaining plate 53 at a bottom end and to the retaining plate 51 at a top end. A retaining clip 48 is pushed in between the side sections 56 between the uppermost counterweight unit 47 and the retaining plate 51 and exerts a pressure directed vertically downwards onto the uppermost counterweight unit 47. A suspension firing 57 is attached in the center of the upper retaining plate 50 to complete the counterweight 18.

Figure 6:
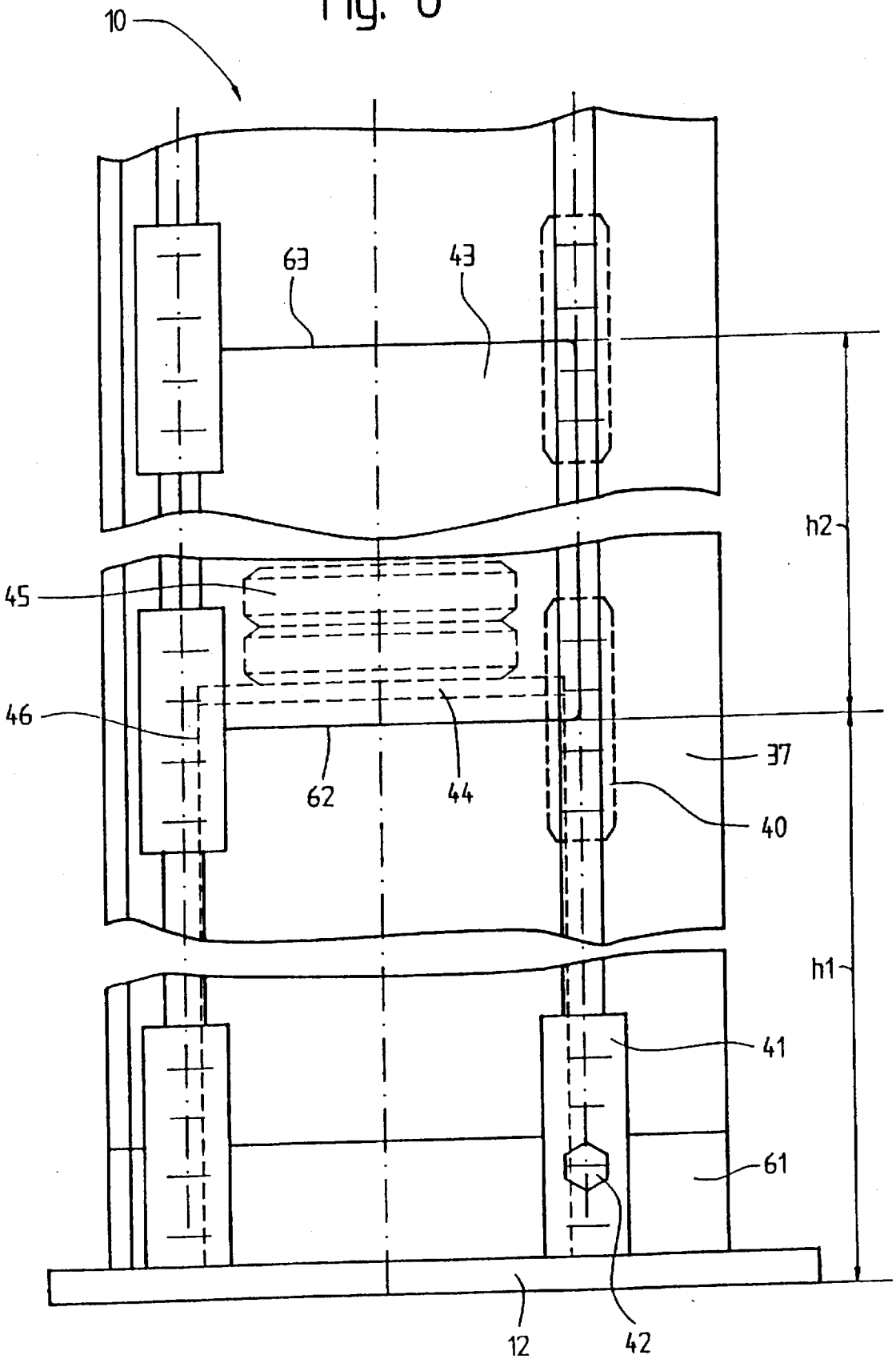
FIG. 6 a side elevation view of the guide module shown in the FIG. 1 with connecting straps, a foundation module, a maintenance lid and buffer equipment.

In FIG. 6, a lower portion of the guide module 10 is illustrated in side elevation. The guide module 10 is firmly attached at the lower end thereof to a stub section 61, formed on the foundation module 12, by the connecting straps 41, the screws 42 and the groove strips 40. Above a first height "h1", the facing portion of the wall of the guide module 10 is cut open horizontally between the vertical joints 58 and 59 to form a first horizontal joint 62. A second horizontal joint 63 is formed between the vertical joints 58 and 59 at a second height "h2" above the first height "h1". That portion of the guide body wall, which is defined by the joints 58, 59, 62 and 63, becomes the maintenance lid 43. When in place, the maintenance lid 43 is firmly connected with the guide module 10 by the connecting straps 41 mounted at four comers thereof. Above the first height "h1", a deformation body 46 is inserted in the interior of the guide module 10 and has an upper end face covered by a pressure plate 44. Elastic buffer elements 45 are stacked on the pressure plate 44.

When the maintenance lid 43 is removed, the deformation body 46 can be inserted into the guide module 10 first and then the pressure plate 44 can be installed. Next, the calculated number of elastic buffer elements 45 are stacked on the pressure plate 44. The counterweight frame 64, consisting of the side sections 56, the retaining plates 50, 51, 52 and 53 and without the sliding guide members 54, can now be inserted through the maintenance opening and set down onto the elastic buffer elements 45. The counterweight frame 64 is now rotated to the correct position and then the sliding guide members 54, which are to be fastened on, are inserted in the guide grooves 31 and 32 to secure against rotation of the counterweight 18. The distance between the side sections 56 is somewhat smaller than the diameter "D" of guide body, hence the possibility of rotation of the counterweight frame 64 without sliding guide members 54. The counterweight frame 64 is dimensioned to receive as many counterweight units 47 as required, for example, to compensate for the empty weight of the car 5 plus 25% of the car maximum load with two of the counterweights 18. Advantageously, the counterweight 18 is connected with the cable 19 before the introduction into the maintenance opening. After the installation of the required counterweight units 47, the retaining clip 48 is inserted for holding down the counterweight units, the retaining section 55 is fastened and the maintenance opening is closed by the maintenance lid 43 which is fastened by the connecting straps 41, the screws 42 and the groove strips 40.

The shaft head module 13 forming the upper termination of the guide 10 is attached with a downwardly directed stub section similar to the stub section 61 with ones of the connecting straps 31. In the case where car 5 is not self-propelled, a drive motor with drive pulley or the like can be mounted on the module 13.

In a simpler embodiment, the guide modules 10 can be transversely connected by standard sections of any desired kind in place of the shaft head module 13 and the foundation module 12, for which the anchoring grooves 33, 34, 35 or 36 can be utilized with an appropriate screw connection.

The four anchoring grooves, which are formed on the outer surface of the body of the guide module 10, can serve the following purposes:

Attachment with the fastening modules 11,
Fastening of the maintenance lid 43,
Attachment of guide module 10 section portions to one another, and with the foundation module 12 and with the head module 13,
Fastening of transverse beams for the mounting of deflecting rollers 14 or the like,
Fastening of equipment for generating the elevator-related shaft information,
Fastening of illumination devices,
Fastening of electrical installation units,
Fastening of different electrical and mechanical equipment such as, for example, switching cams, heating appliances, alarm devices, discharge tubes and so forth,
Fastening of shaft cladding elements of any kind,
Fastening of decorative and/or promotional elements,
Fastening of climbing aids such as, for example, ladder elements and
Fastening of frame bases, possibly in combination with the fastening modules.

If the guide modules 10 are formed of magnetically non-conductive material, the first elements 65 of the shaft information device can be, for example, permanent magnets fastened directly by the groove strips 40, the connecting straps 41 and the screws 42 at desired positions in the anchoring grooves 33, 34, 35 or 36. Also, shaft switches of any kind can be mounted in this manner directly in or on short arms in the anchoring grooves 33, 34, 35 or 36. The body sections of the guide module 10 can be formed of aluminum or a lightweight metal alloy in an extrusion process.

The brake arm 37, which extends outwardly adjacent the anchoring groove 33, is engaged by a not illustrated car-arresting device mounted on the car 5 and serves, when the car-arresting device is triggered, together with brake wedges for the emergency braking of the car in the case of an impermissible exceeding of the nominal speed. The functional separation of the running surfaces 29 and 30 and the brake surfaces on the brake arm 37 takes the different requirements of driving and braking into account and has the great advantage that no surfaces, which have been roughened by arresting brakings, impair the travelling comfort and the coefficient of friction of the running surfaces. A coating, which stabilizes the coefficient of friction, is applied to the running surfaces 29 and 30. This coating, for example a metal oxide, causes a far-reaching independence of the coefficient of friction in different states (dry, moist, wet, dirty) of the running surfaces 29 and 30. A roller or wedge car-arresting device, which is typically used, can be used as the car-arresting device. The projection 39 adjacent the anchoring groove 34 serves as a sufficiently wide running surface 16 for the guide rollers 9.

The anchoring grooves, apart from the above explained intended purposes, also increase the stability and resist buckling in all axes between the guide axis 25 and the "X" axis.

In addition to the anchoring grooves 33, 34, 35 and 36, the horizontally extending arms of the fastening modules 11 also serve different fastening functions. Since these telescopically extending fastening modules 11 are preferably positioned at threshold height for each of the floors 3, their arm provide an ideal opportunity for the arrangement and fastening of the floor-related shaft information devices such as, for example, a door-bridging zone, a final regulating zone and a floor zero zone. Moreover, they can serve as frame bases temporarily needed as supports during the assembly phase.

The planar running surfaces 29 and 30 provide a contact surface extending over the entire width of the drive wheel 7 and the supporting wheel 8 for a friction wheel drive, whereby an appropriate distribution of the contact pressure is achieved over the width of these running surfaces.

The guide module 10 or the brake arm 37 has a strength which is comparable with the guide arm of a classical, T-shaped guide rail. Preferably, non-ferrous metals or also fiber-reinforced synthetic materials are used as constructional material for the guide modules 10. In a further developed form, the formation of a second brake arm 37 is possible.

The anchoring grooves 33, 34, 35 and 36 and their location are not restricted to the example shown and can be constructed and arranged in different variants in respect of number, position and groove shape. Also, the internal shape of the guide body is not restricted to the example shown in that, for example, the guide grooves 31 and 32 can be shaped and/or positioned differently as well as be shaped and/or positioned one differently from the other.

A honeycomb element with vertical structure and of suitable material can, for example, be used as the deformation element 46. A not illustrated safety switch is actuated in the case of a possible deformation due to an abnormally strong impact, for example, in consequence of fracture of the cables 19 or their fastening.

The elastic buffer elements 45, which are stacked on the pressure plate 44, are in adaptation to the respective loading made of synthetic or natural, rubber-like material with an appropriate inherent damping and elasticity specific to the material.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for supporting and guiding an elevator comprising: a pair of guide modules (10) for guiding an elevator car (5), each said guide module (10) having a tubular body with at least one generally planar running surface (29, 30) formed on an exterior surface thereof for contact with a wheel (7, 8) mounted on the car (5), at least one anchoring groove (33, 34, 35, 36) formed on said exterior surface and at least one brake arm (37) extending outwardly therefrom for contact with a car-arresting device mounted on the car (5).

2. The apparatus according to claim 1 wherein each said guide module (10) has a first said generally planar running surface (29) formed on said exterior surface thereof for contact with a supporting wheel (8) mounted on the car (5), a second said generally planar running surface (30) formed on said exterior surface thereof for contact with a drive wheel (7) mounted on the car (5), a third and a fourth generally planar running surfaces (16, 16) formed on said exterior surface thereof for contact with a pair of guide rollers (9) mounted on the car (5), and a fifth generally planar running surface (25) formed on said exterior surface thereof for contact with another guide roller (9) mounted on the car (5).

3. The apparatus according to claim 1 wherein said tubular body of each said guide module is formed of at least two sections and said anchoring grooves (33, 34, 35, 36) are positioned outside said running surfaces (29, 30) for receiving fastening means (40, 41, 42) for attaching said sections together.

4. The apparatus according to claim 1 wherein said body of each said guide module (10) is formed as an extrusion of one of aluminum and a lightweight metal alloy materials.

5. The apparatus according to claim 1 wherein said guide modules (10) are attached at upper ends thereof to a shaft head module (13) and at lower ends thereof to a foundation module (12), said shaft head module (13) and said foundation module (12) each including a pair of stub sections (61) attached to associated ends of said guide modules (10).

6. The apparatus according to claim 1 wherein said tubular body of each said guide module said stub sections 61 have said anchoring grooves (33, 34, 35, 36) formed thereon for receiving fastening means (40, 41, 42) for attaching said shaft head module 13 and said foundation module 12 to said guide modules 10.

7. The apparatus according to claim 1 wherein each said guide module (10) has an interior surface with at least one guide groove (31, 32) formed thereon for engaging a counterweight (18) movable in said guide module (10).

8. The apparatus according to claim 1 wherein each said guide module (10) includes at least one removable maintenance lid (43) positioned between a pair of said anchoring grooves (33, 34) and covering a maintenance opening formed in said wall of said guide module (10).

9. The apparatus according to claim 8 wherein said maintenance opening is sized to receive a counterweight (18).

10. The apparatus according to claim 8 including a buffer (44, 45, 46) positioned at a lower end of each said guide module 10 and wherein said maintenance opening is sized to receive said buffer (44, 45, 46).

11. An apparatus for supporting and guiding an elevator comprising:

a pair of guide modules (10) for guiding an elevator car (5), each said guide module (10) including a sectional tubular body having first and second generally planar running surfaces (29, 30) formed on an exterior surface thereof for contact with wheels (8, 7) mounted on the car (5), a plurality of anchoring grooves (33, 34, 35, 36) formed on said exterior surface for attaching said sections to one another, a brake arm (37) extending outwardly therefrom for contact with a car-arresting device mounted on the car (5), third and fourth generally planar running surfaces (16, 16) formed on said exterior surface thereof for contact with a pair of guide rollers (9) mounted on the car (5), and a fifth generally planar running surface (25) formed on said exterior surface thereof for contact with another guide roller (9) mounted on the car (5);

a shaft head module (13) connecting upper ends of said guide modules (10) together;

a foundation module (12) connecting lower ends of said guide modules (10) together; and a plurality of fastening means (40, 41, 42) received in said anchoring grooves (33, 34, 35, 36) attaching said sections together and attaching said shaft head module (13) and said foundation module (12) to said guide modules (10).

12. The apparatus according to claim 11 wherein said shaft head module (13) and said foundation module (12) each include a pair of stub sections (61) attached to associated ones of said upper and lower ends of said guide modules (10).

13. The apparatus according to claim 11 wherein each said guide module (10) has an interior surface with at least one guide groove (31, 32) formed thereon for engaging a counterweight (18) movable in said guide module (10).

14. The apparatus according to claim 11 wherein each said guide module (10) includes at least one removable maintenance lid (43) positioned between a pair of said anchoring grooves (33, 34) and covering a maintenance opening formed in said wall of said guide module (10).

15. The apparatus according to claim 14 wherein said maintenance opening is sized to receive a counterweight (18).

16. The apparatus according to claim 14 including a buffer (44, 45, 46) positioned at said lower end of each of said guide modules (10) and wherein said maintenance opening is sized to receive said buffer (44, 45, 46).

17. An apparatus for supporting and guiding an elevator comprising:

a pair of guide modules (10) for guiding an elevator car (5), each said guide module (10) including a sectional tubular body having first and second generally planar running surfaces (29, 30) formed on an exterior surface thereof for contact with wheels (8,7) mounted on the car (5), a plurality of anchoring grooves (33, 34, 35, 36) formed on said exterior surface for attaching said sections to one another, a brake arm (37) extending outwardly therefrom for contact with a car-arresting device mounted on the car (5), third and fourth generally planar running surfaces (16, 16) formed on said exterior surface thereof for contact with a pair of guide rollers (9) mounted on the car (5), and a fifth generally planar running surface (25) formed on said exterior surface thereof for contact with another guide roller (9) mounted on the car (5);

a shaft head module (13) connecting upper ends of said guide modules (10) together;

a foundation module (12) connecting lower ends of said guide modules (10) together;

a plurality of fastening means (40, 41, 42) received in said anchoring grooves (33, 34, 35, 36) attaching said sections together and attaching said shaft head module (13) and said foundation module (12) to said guide modules (10);

a counterweight (18) movable in each said guide module (10), each said guide module (10) having an interior surface with at least one guide groove (31, 32) formed thereon for engaging and guiding said counterweight (18); and a removable maintenance lid (43) positioned between a pair of said anchoring grooves (33, 34) and covering a maintenance opening formed in said wall of each said guide module (10), said maintenance opening being sized to receive said counterweight (18).

18. The apparatus according to claim 17 including a buffer (44, 45, 46) positioned at said lower end of each of said guide modules (10) and wherein said maintenance opening is sized to receive said buffer (44, 45, 46).

* * * * *